United States Patent [19]

Dickinson

[11] 4,292,953

[45] Oct. 6, 1981

[54] POLLUTANT-FREE LOW TEMPERATURE SLURRY COMBUSTION PROCESS UTILIZING THE SUPER-CRITICAL STATE

[76] Inventor: Norman L. Dickinson, Box 211, Lavallette, N.J. 08735

[21] Appl. No.: 948,682

[22] Filed: Oct. 5, 1978

[51] Int. Cl.[3] ..... F24J 3/00

[52] U.S. Cl. ..... 126/263; 110/106; 110/204; 110/216; 110/266; 110/345; 122/4 R

[58] Field of Search ..... 110/347, 266, 265, 342–345, 110/204, 216, 232, 106; 431/4 R, 190; 122/4 R

[56] References Cited

U.S. PATENT DOCUMENTS

| | | | |
|---|---|---|---|
| 772,704 | 10/1904 | Detweiler | 122/4 R |
| 955,977 | 4/1910 | Mirick | 122/4 R |
| 1,027,815 | 5/1912 | Bynoe | 122/4 R |
| 1,970,109 | 8/1934 | Stratton | 110/266 |
| 2,547,135 | 4/1951 | Mercier | 122/4 R |
| 2,601,667 | 6/1952 | Permann | 110/205 X |
| 3,089,539 | 5/1963 | Vermillion et al. | 431/4 R |
| 3,207,102 | 9/1965 | Seibold | 110/265 |
| 3,313,251 | 4/1967 | Jonakin | 110/265 |
| 3,818,869 | 6/1974 | Blaskowski | 110/345 |
| 3,941,552 | 3/1976 | Cottell | 431/4 |
| 4,013,428 | 3/1977 | Babbitt | 110/347 X |
| 4,052,138 | 10/1977 | Gieck | 431/4 |
| 4,057,021 | 11/1977 | Schoppe | 110/347 X |
| 4,147,134 | 4/1979 | Vogt et al. | 110/205 X |

*Primary Examiner*—Stephen P. Garbe

[57] ABSTRACT

A continuous process for the combustion of solid fuels in the presence of an aqueous liquid phase under conditions such that oxides of nitrogen are not formed and oxides of sulfur and particles of ash are effectively prevented from contaminating the gaseous products released to the atmosphere. Fuel is charged as a slurry in alkaline aqueous solution and contacted with combustion air so that the catalytic properties of both water and alkali operate to permit rapid and complete combustion at comparatively low temperatures. Temperatures in the adiabatic reactor are, however, permitted to exceed the critical temperature of the liquid phase. Under the conditions of the process, formation of nitrogen oxides is negligible, sulfur in the fuel goes to sulfur trioxide which dissolves completely in the alkaline liquid phase which also retains particles of ash and unburned fuel. The resulting flue gas is essentially free from objectionable pollutants. Heat is made available at a temperature high enough to generate and superheat steam.

16 Claims, 2 Drawing Figures

208
210
216
230
232
234
236
238
240
242
244
246
248
250
252
254
256
258
260
261
262
264
266
268
270
272
274
276
278

POLLUTANT-FREE LOW TEMPERATURE SLURRY COMBUSTION PROCESS UTILIZING THE SUPER-CRITICAL STATE

BACKGROUND OF THE INVENTION

This invention concerns the utilization of the heating values of carbonaceous fuels for the production of useful thermal, mechanical or electrical energy.

Burning coal to generate steam is one of the oldest of the industrial arts. Numerous inventions have been applied to improving its efficiency and alleviating the co-production of noxious smoke, which tends to contain unburned fuel, finely powdered ash and oxides of sulfur and nitrogen. Nevertheless, even with the latest technology, coal is considered a dirty fuel, capable only with great difficulty and expense of complying with increasingly stringent air pollution standards.

The high cost of removing sulfur oxides from conventional flue gasses has resulted in a spread between the prices of low and high sulfur coals. Moreover, the former are found, for the most part, in western states remote from the areas of greatest energy need. Thus, the market price structure provides economic incentive for the commercialization of a process able to produce steam and power from high sulfur coals without atmospheric pollution.

Combustion of coal in conventional ways creates temperatures well above 2000° F. Conventional apparatus must therefore be constructed of expensive materials capable of withstanding such temperatures. Moreover, components of the ash frequently melt (slag) forming deposits which foul parts of the apparatus, causing loss of efficiency, downtime and increased maintenance expense. A further undesirable consequence of the usual combustion temperatures is the inadvertant formation of nitrogen oxides which cannot be effectively and economically removed from flue gas with available technology.

Generation of high pressure steam does not inherently require such high temperatures since the boiling point of water at 2000 pounds per square inch is only about 635° F. and at 3000 pounds per square inch about 695° F.

Some experimental combustion systems, particularly those employing fluidized beds of finely divided solids at elevated pressure, permit combustion in a lower temperature range, typically 1500° to 1700° F. Although nitrogen oxides are thus largely avoided, expensive temperature-resistant construction is still required and new difficulties, associated with the maintenance of fluidized solids properties, erosion and removal of dust from gas streams, are entailed.

It has also been proposed to burn coal without air pollution by the indirect means of first converting it to liquid or gaseous fuel which can be desulfurized before combustion to a clean flue gas. These techniques also employ high temperatures and generally share serious economic and operational drawbacks associated with coal's tendency to cake and stick when heated, the formation of tarry residues and difficulties with erosion and dust control. These techniques are further burdened by low overall thermal efficiencies.

It has been known for more than 70 years that liquid water accelerates the reaction between coal and atmospheric oxygen. In 1908, Dr. S. W. Parr (University of Illinois Bulletins 17 and 46) reported, "The presence of moisture increases the chemical reactivity of the coal-air system at any temperature." The quantitative effect for various coals has been extensively documented over the years. Ordinary combustion processes cannot take advantage of this phenomenon because wet coal must be dried before it will ignite.

Likewise, the catalytic effect of common alkalis such as soda ash (sodium carbonate) and limestone (calcium carbonate) on the reactivity of carbonaceous materials is well known and has been utilized in the gasification of coal and coke. Alkaline compounds are also used in commercial steam-hydrocarbon reforming catalysts to prevent carbon buildup by speeding up its oxidation to gaseous products. Conventional combustion processes do not employ alkaline catalysts because at the high temperatures they would volatilize and/or combine with ash ingredients to form troublesome slag or clinker.

SUMMARY OF THE INVENTION

Carbonaceous fuel is ground or pulverized and charged as a slurry in an alkaline aqueous solution, along with combustion air and recycled water, to an adiabatic combustion zone. The pressure of the zone is preferably sufficient to maintain a portion of the solution in liquid phase up to the critical temperature of water (705.4° F.) above which combustion continues in dense phase. The catalytic properties of both water and alkali operate to permit essentially complete combustion within a temperature range in which there is negligible formation of nitrogen oxides. Sulfur is oxidized to the trioxide. As useful heat is extracted from the combustion products, the critical temperature is reached again and liquid water re-appears. The sulfur trioxide dissolves completely in the alkaline liquid phase which also traps the particles of ash, thereby producing a pollutant-free flue gas. Even though the maximum temperature is well below those customary to combustion processes, it is sufficiently high to generate and superheat high pressure steam.

An object of the invention is to provide a practical and economical means of obtaining heat and power from coal and other carbonaceous fuels without polluting the atmosphere. Another object is to make it economically possible to utilize reserves of fuels with high contents of sulfur, ash, water or other contaminants which are poorly suited to conventional combustion methods. A further object is to provide a means of limiting the maximum temperature in a combustion process without loss of thermal efficiency.

DESCRIPTION OF PREFERRED EMBODIMENTS

Figure 1:
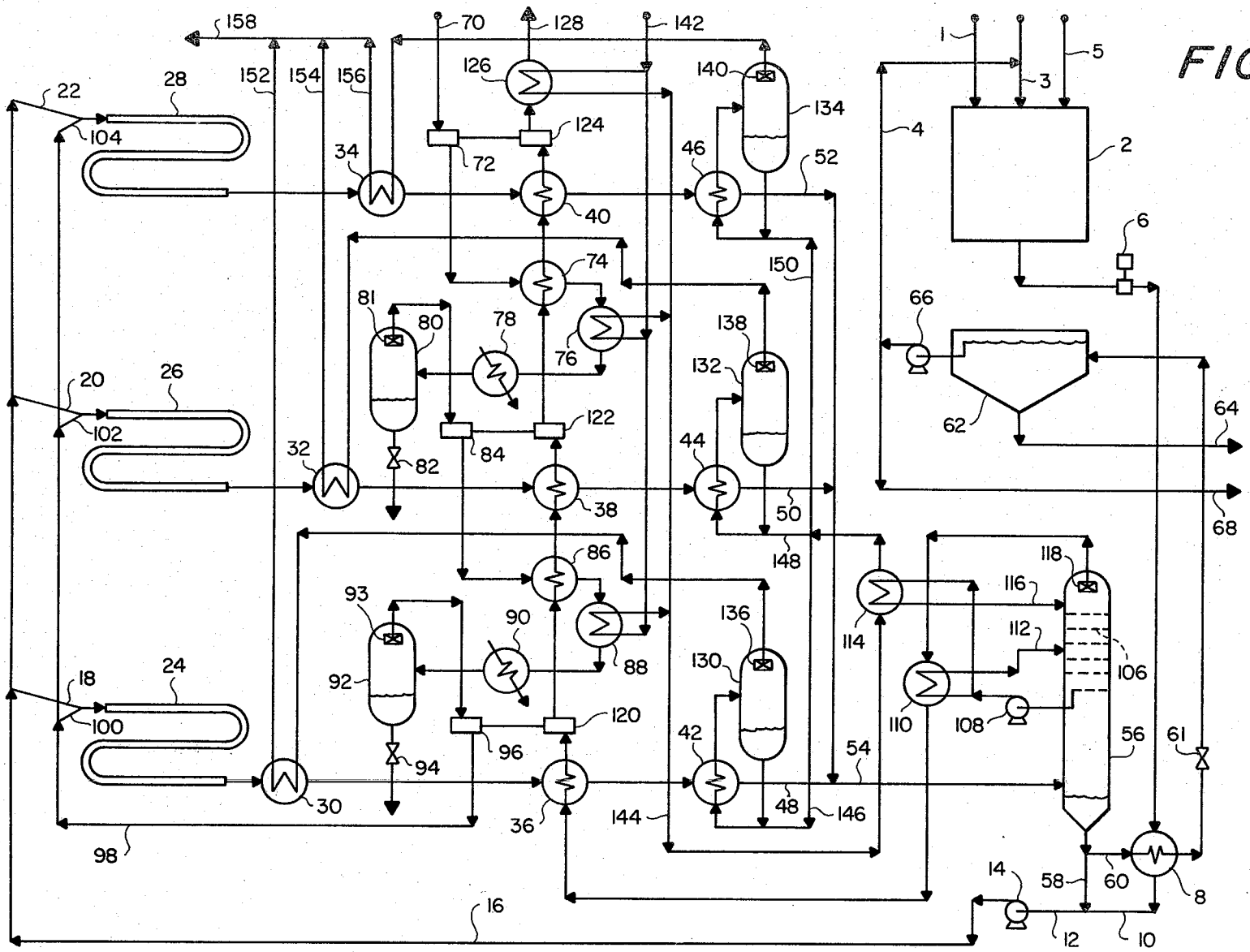
FIG. 1 is a schematic elevational diagram illustrating a system for implementing one embodiment of the process of the invention.

With reference to FIG. 1, crushed coal from a suitable source is supplied through a conduit 1 to a conventional grinding and slurrying system 2 in which it is mixed with water coming from a suitable storage facility through a line 3 and recycled solution entering by means of a line 4. Powdered, granular, dissolved or slurried alkali is added to the mixture via a conduit 5. A coal slurry charge pump 6 draws the resulting slurry from the system 2 and provides sufficient pressure to cause it to flow through a preheat exchanger 8 and lines 10 and 12 to the suction of a reactor charge pump 14. The coal slurry in the line 10 is joined by recycled ash slurry from a line 58, the combined stream comprising the slurry pumped by the pump 14 through a line 16 to the inlets of combustion reactors 24, 26 and 28.

FIG. 1 illustrates a system comprising three parallel reaction trains. By "train" I mean an interconnected set of equipment comprising a reactor and its associated heat exchangers. This number of trains was selected to correspond with the number of compression stages which was determined by the combustion pressure. (In other cases, more or fewer compression stages may be specified.) The flow through each of the reaction trains may be represented by a detailed description of the flow through the one nearest the bottom of the drawing.

Coal slurry mixed with recycled ash slurry in the line 16 is divided into three approximately equal streams represented by lines 18, 20, and 22. Similarly, compressed air in a line 98 is divided into three approximately equal streams represented by lines 100, 102 and 104. The slurry in the line 18 mixes with the air in the line 100 and the mixture flows into the reactor 24 in which time is provided during its passage for essentially complete combustion of the coal. As the heat of combustion is released, the temperature of the flowing mixture increases. At a point part way through the reactor 24, the critical temperature of the aqueous phase is reached and, as the temperature continues to rise, gas and formerly liquid phases become a single dense phase.

Hot dense phase fluid containing suspended ash particles leaves the downstream end of the reactor 24, and its contained high level heat is first used to superheat product steam by indirect exchange in a steam superheat exchanger 30. Then, somewhat cooled, it flows to a first-stage flue gas superheat exchanger 36 in which it gives up a further portion of its contained heat to high pressure flue gas entering a first-stage flue gas turbine 120. The reaction effluent then flows to a boiler 42 in which more of its sensible heat and most of the latent heat of the aqueous portion of the mixture is given up by indirect transfer to boiling feedwater.

A steam drum 130 is provided to separate between water and steam leaving the cold side of the boiler 42. The water being recycled to the boiler 42 while the steam is purified of entrained water particles in a mist extractor 136. The purified steam flows to the cold side of the steam superheat exchanger 30 in which it is superheated, as previously described, to its final delivery temperature.

Similarly, hot dense-phase effluent of the reactor 26 supplies heat successively to a steam superheat exchanger 32, a second-stage flue gas superheat exchanger 38 and a boiler 44, which is equipped with a steam drum 132. Also similarly, the hot dense-phase effluent of the reactor 28 supplies heat successively to a steam superheat exchanger 34, a third-stage flue gas superheat exchanger 40 and a boiler 46, also equipped with a steam drum 134.

Steam from the drums 132 and 134 is freed of entrainment in mist extractors 138 and 140, respectively, and flows to the steam superheat exchangers 32 and 34, respectively, in which it, also, is superheated to final delivery temperature. Superheated steam leaving the superheat exchangers 30, 32 and 34 flows by means of lines 152, 154 and 156, respectively, to join in a line 158 which conducts it from the apparatus as product of the process.

The cooled and partially condensed reaction effluents from the three reaction trains, leaving their respective boilers via lines 48, 50 and 52, join in a line 54 which conducts the combined stream to a separator vessel 56. In the lower section of the separator vessel 56, gravity causes the ash slurry to separate and collect in the bottom from which it is continuously withdrawn. A portion of the ash slurry withdrawn from the separator vessel 56 flows by means of the line 58 to the line 1 and the suction of the reactor charge pump 14. This portion, known as internal recycle, returns to the reaction system as a means of controlling phase conditions in the inlet, or pre-critical, regions of the reactors, of moderating the temperature rise and of converting residual carbon which, without recycling, might have left the system with product ash.

A net portion of the ash slurry withdrawn from the bottom of the separator vessel 56 flows via a line 60 under control of a control valve 61 through the hot side of the coal slurry preheat exchanger 8 to an ash settler 62. Having been cooled by giving up heat in the exchanger 8, the ash slurry enters the settler 62 in which gravity causes the solid ash particles to concentrate in the conical bottom section from which they are withdrawn for disposal through a line 64. The liquid portion in the upper part of the ash settler 62, from which most of the ash has been separated, flows to a solution pump 66 which causes it to flow to a point of division between a portion which is purged from the apparatus via a line 68 and a portion, known as external recycle, which is recycled through the line 4 to the grinding and slurrying system 2.

Referring again to the separator vessel 56, the gaseous portion of the mixture which entered via the line 54, comprising flue gas plus water vapor of saturation, flows upward through a rectification zone comprising a number of vapor-liquid contacting elements 106, such as perforated fractionating trays, countercurrent to a descending cascade of water, circulated by a circulating reflux pump 108. Hot water, approaching in temperature the gaseous phase rising from the lower section of the vessel 56, is withdrawn from the lower of the contacting elements by the pump 108 and caused to flow through the hot sides of a boiler feedwater circulating reflux exchanger 114 and a flue gas preheat exchanger 110 before being returned to the top and middle, respectively, of the rectification zone. Having been cooled in the exchangers 110 and 114, the water returned to the rectification zone via lines 112 and 116, respectively, is capable, in turn, of cooling the flue gas flowing upward through the zone and condensing from it the major part of the water vapor it contained when separated from the ash slurry. The water so condensed flows downward from the lowest contacting element to join the ash slurry in the bottom of the separator vessel 56.

The cooled flue gas leaving the uppermost contacting element is passed through a mist extractor 118 to free it of entrained water droplets and then reheated successively in the preheat exchanger 110 and the first-stage flue gas superheat exchanger 36. The heated flue gas is then expanded through the first-stage flue gas turbine 120 which delivers mechanical energy in the form of shaft horsepower to a third-stage air compressor 96. Having been cooled by giving up energy in the turbine 120, the flue gas, now at a reduced pressure level, is reheated successively by hot compressed air in a second-stage air-flue gas exchanger 86 and hot reactor effluent of the middle of the illustrated reaction trains in the second-stage flue gas superheat exchanger 38.

The reheated flue gas leaving the exchanger 38 is then expanded a second time through a second-stage flue gas turbine 122 which delivers mechanical energy to a second-stage air compressor 84. Having been again cooled by giving up energy in the turbine 122, the flue gas, now at a further reduced pressure level, is reheated successively by hot compressed air in a first-stage air-flue gas exchanger 74 and hot reactor effluent of the upper of the illustrated reaction trains in the third-stage flue gas superheat exchanger 40.

The reheated flue gas leaving the exchanger 40 is then expanded a third time through a third-stage flue gas turbine 124 which delivers mechanical energy to a first-stage air compressor 72. The expanded flue gas, partially cooled by having given up energy in the turbine 124 and now at a pressure only slightly above atmospheric, flows through an economizer exchanger 126 before being released through a suitable vent 128 to the atmosphere. In the economizer 126, similar to those employed to effect a final heat recovery from the flue gasses of conventional boilers, residual heat in the flue gas exhausted from the turbine 124 is recovered to preheat cold boiler feedwater returning to the apparatus from the condensers of conventional turbo-generators through a line 142.

Boiler feedwater from the line 142, under pressure from a conventional feedwater pump external to the apparatus, is also preheated in a first-stage air-boiler feedwater exchanger 76 and a second-stage air-boiler feedwater exchanger 88, before combining in a line 144. The line 144 carries it to the boiler feedwater-circulating reflux exchanger 114 for the final stage of heating before being divided three ways through lines 146, 148 and 150 to supply the feedwater requirements of the boilers 42, 44 and 46, respectively.

Combustion air is filtered in a conventional manner (not shown) to protect the equipment from airborne solids and conducted via a conduit 70 to the suction of the first-stage air compressor 72 which delivers it hot and at an elevated pressure level to the first-stage air-flue gas exchanger 74 in which it is partially cooled by giving up heat to third-stage flue gas, as previously described. The first-stage compressed air is then further cooled in the first-stage air-boiler feedwater exchanger 76, as previously described. Final cooling of the first-stage compressed air is effected by indirect exchange with plant circulating cooling water in a first-stage compressed air cooler 78.

Atmospheric air contains a variable amount of water vapor (humidity). Most of the water vapor contained in the combustion air drawn into the apparatus condenses to liquid water during the final cooling of first-stage compressed air in the cooler 78. This water is separated from the air in a second-stage air compressor suction drum 80 and a mist extractor 81 and discharged from the system through a control valve 82.

The dried first-stage compressed air flows from the mist extractor 81 to the suction of the second-stage air compressor 84 which delivers it hot and at a further increased pressure level to the second-stage air-flue gas exchanger 86 in which it is partially cooled by giving up heat to second-stage flue gas, as previously described. The second-stage compressed air is then further cooled in the second-stage air-boiler feedwater exchanger 88, as previously described. Final cooling of the second-stage compressed air is effected by indirect exchange with plant circulating cooling water in a second-stage compressed air cooler 90. A very small amount of liquid water condenses also in cooler 90 and is separated from the air in a third-stage air compressor suction drum 92 and a mist extractor 93 and discharged from the system through a control valve 94.

The dried second-stage compressed air flows from the mist extractor 93 to the suction of the third-stage air compressor 96 which delivers it hot and slightly above reactor pressure to a line 98 which, in turn, supplies combustion air through the lines 100, 102 and 104, respectively, to the points of mixing with incoming slurry at the inlet connections of the reactors 24, 26 and 28, respectively.

As fuel slurry and air flow together through an adiabatic reactor, as employed in the process of the invention, the temperature continues to rise so long as fuel and oxygen remain to be consumed. As the temperature increases, more and more water vapor is required to saturate the gas phase (up to the critical temperature where the phases become the same). In order for there to be enough water in the mixture to maintain sufficient liquid to slurry the unburned coal and ash particles at the critical temperature, as is considered preferable, a relatively large amount must be supplied at the reactor inlet. It is normally inconvenient and uneconomical to supply so much water by means of the coal slurry charged. It is thermally and hydraulically more efficient to recycle water in the form of ash slurry from the separator, which is both hot and under system pressure (internal recycle).

A possible limitation exists, however, in the amount and nature of salts dissolved in the ash slurry water. This salts concentration is obviously a function of the content of sulfur and soluble materials in the particular coal charged and the alkali added. It is also a function of the proportion of clarified ash slurry water from the ash settler which is recycled to the feed slurry (external recycle). Because the water remaining liquid at the point in the reaction system where the critical temperature is reached is a small fraction of the total supplied, it follows that solution which enters the reactor dilute can become concentrated or supersaturated. With certain types of salts, this concentration effect can result in scaling in the reactor or scaling and/or plugging in downstream heat exchange equipment.

Figure 2:
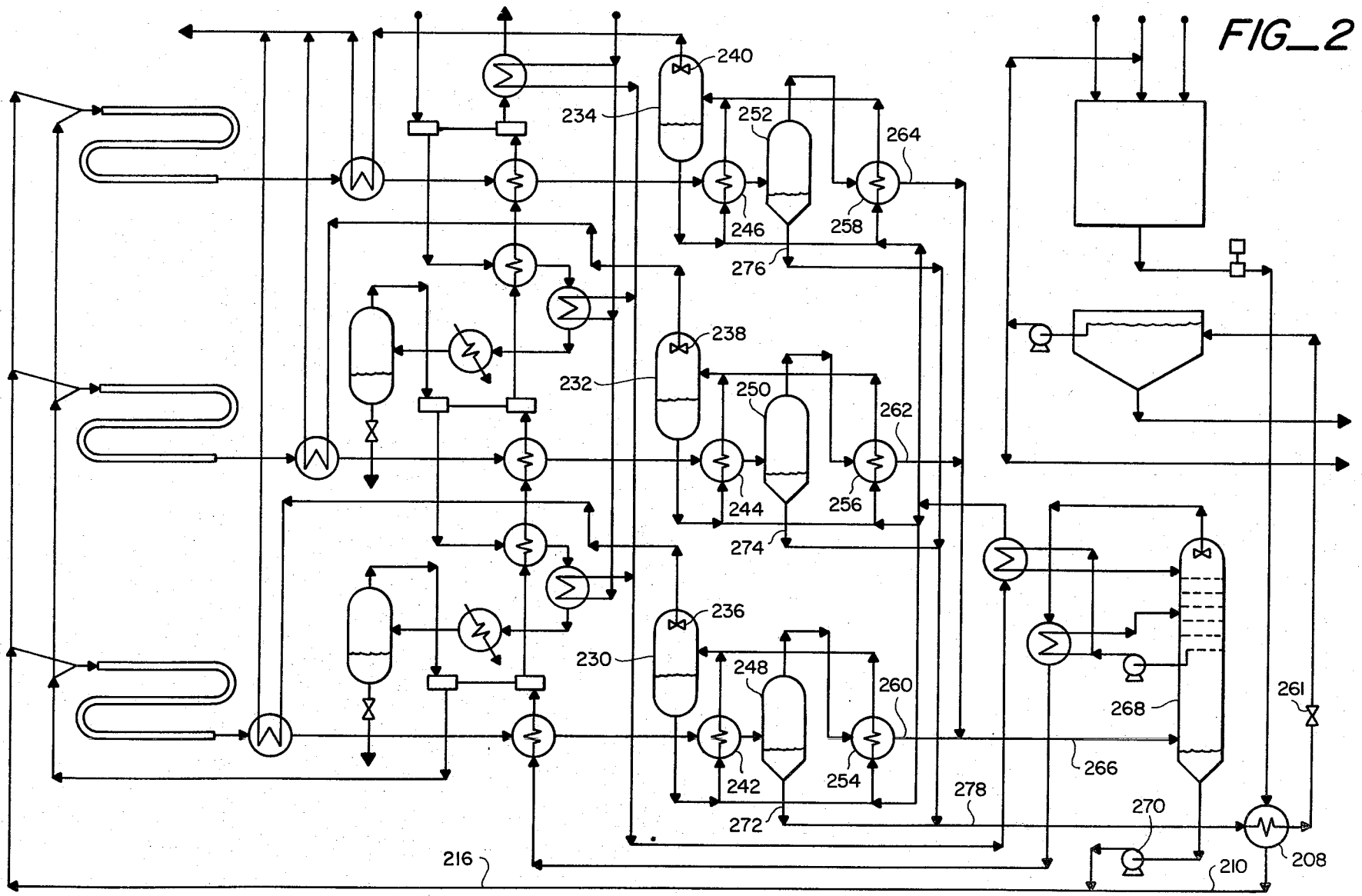
FIG. 2 is a schematic elevational diagram illustrating a system similar to that of FIG. 1, but adapted to fuels with high contents of impurities.

The embodiment of FIG. 2 is particularly applicable to the combustion of fuels, or the use of alkalis, which are prone to cause scaling or fouling in reaction and heat recovery trains. It differs from the embodiment of FIG. 1 in that cooling and recovery of latent heat of water in the reaction effluent, for the generation of product steam, is carried out in two steps, rather than one. The water condensed in the first step collects essentially all of the salts and ash particles. This slurry is then withdrawn through the ash settler as in FIG. 1. The water condensed in the second step is comparatively pure and comprises the internal recycle returned in quantity to the reactor inlets for purposes of saturating the reacting gasses at the critical temperature.

With reference to FIG. 2, and specifically to the lower of the three reaction trains, reaction effluent, having been partially cooled in a steam superheat exchanger and a flue gas superheat exchanger (as in FIG. 1), flows to a primary boiler 242 in which it is further cooled by the indirect transfer of heat to boiling water. The design and operation of the primary boiler 242 is such that it cools the reaction effluent to a temperature at which sufficient of its contained water vapor is condensed to suitably slurry the ash and other solid particles, as well as to dissolve soluble salts and excess alkali.

The mixture of flue gas, water vapor and ash slurry leaving the cold side of the primary boiler 242 flows to a primary separator 248 in which a separation is made between ash slurry, which is withdrawn through a line 272, and the gaseous phase which leaves the top of the separator 248 and flows to a secondary boiler 254. In the secondary boiler 254, indirect transfer of heat to boiling water further cools the reaction effluent and condenses from it that portion of the remaining water vapor whose latent heat is available at a temperature high enough to generate steam of the pressure desired. Since virtually all of the soluble and insoluble solid matter in the reaction effluent has already been carried away by the water condensed in the primary boiler 242, that condensed in the secondary boiler 245 is comparatively pure.

The corresponding items of the middle reaction train are a steam superheat exchanger, a flue gas superheat exchanger (as in FIG. 1), a primary boiler 244, a primary separator 250 and a secondary boiler 256. The corresponding items of the upper reaction train are a steam superheat exchanger, a flue gas superheat exchanger (as in FIG. 1), a primary boiler 246, a primary separator 252 and a secondary boiler 258.

A mixture of flue gas, water vapor and liquid water leaves the hot side of the secondary boiler 254 via a line 260 and joins in a line 266 the similar mixtures leaving the middle reaction train via a line 262 and leaving the upper reaction train via a line 264. The combined mixture then enters a secondary separator 268 which performs a function identical to that of the separator 56 of FIG. 1, except that the liquid phase collected in and removed from the bottom is water, rather than an aqueous ash slurry. In the embodiment of FIG. 2, this hot water comprises the internal recycle pumped by an internal recycle pump 270 to the point of mixing with a coal slurry incoming to the reaction system via a line 210, the combined streams being conveyed to inlets of three reactors by means of a line 216.

The ash slurry leaving the lower reaction train through the line 272 joins in a line 278 with the ash slurries similarly withdrawn from the middle reaction train through a line 274 and from the upper reaction train through a line 276, the combined ash slurry comprising the heating medium for cold incoming coal slurry in an ash slurry-coal slurry exchanger 208. Having been cooled by this heat exchange, the ash slurry leaves the high pressure portion of the apparatus through a control valve 261. Subsequent treatment of the ash slurry is identical to that of the embodiment of FIG. 1.

Boiler feedwater, having been preheated as in FIG. 1, divides and supplies the make-up water required by both primary and secondary boilers of the three reaction trains. Mixtures of steam and water leaving the cold sides of the primary boiler 242 and the secondary boiler 254 join in flowing to a steam drum 230 in which water is separated, for recycling to the two boilers, from steam, which is dried in a mist extractor 236 prior to being superheated as in FIG. 1. The functions of a steam drum 232 and a mist extractor 238 of the middle reaction train and of a steam drum 234 and a mist extractor 240 of the upper train are similar to those of the corresponding items of the lower train.

While in the illustration of FIG. 2 the steam drums are common to their respective primary and secondary boilers, each of these boilers may have its own steam drum, in which case the steam drum of the secondary boiler may operate at a pressure lower than that of the primary boiler. Also, a single primary steam drum may serve the primary boilers of more than one reaction train. Similarly, a single secondary steam drum may serve the secondary boilers of more than one reaction train.

DESCRIPTION OF THE INVENTION

In practicing the process of the invention, coal is ordinarily received, stored, and conveyed and crushed in ways familiar to the thermal power industry. It may also be pulverized in grinding mills similar to those used for preparing fuel for conventional powdered coal burners. However, in many cases, it is more convenient to employ some of the known wet grinding techniques, using water and/or recycled solution as the liquid medium. The process of the invention is particularly advantageous when coal is conveyed to the site by coal slurry pipeline because it does not need to be dewatered and dried, but may be charged to the process with no further preparation.

For convenience in the description of the process of the invention, I have referred to carbonaceous fuels as coal. It is to be understood, however, that it applies similarly to any solid or semi-solid combustible material including, but not limited to, petroleum coke, char, lignite, waste wood products and fuels of vegetable or organic origin known collectively as "biomass".

Usually, recycled solution supplies most of the liquid needed to make up the charge slurry. Water is added (if not already present with the fuel) as required to dilute the slurry to a consistency which flows and pumps without difficulty. Water from almost any source is suitable—it does not require special purification. The minimum amount of slurry water (recycled plus make-up) depends upon the physical properties of the coal and may be as low as 50 weight percent. However, there is little economy in minimizing the slurry water and, ordinarily, 60 percent or more will be used.

Alkali is added to the coal slurry as a combustion catalyst and to neutralize the acids (principally sulfuric) formed during the combustion. The amount need only be a small excess over that needed for neutralization. While not ordinarily required, combustion catalysts other than alkalis may also be added to the coal slurry.

The alkalized fuel slurry is preferably pumped to the pressure of the reaction system with slurry pumps although other known methods of charging slurries to pressurized systems, such as blow cases, hydraulic displacement, etc. may be used.

In the illustrations, water in the fuel slurry from the grinding and slurrying system is shown to be supplemented at the inlets of the reactors with additional water in the form of water or ash slurry recycled from a separator within the high pressure section of the apparatus. While the total amount of water entering the reactors is preferably sufficient to maintain liquid phase to the critical temperature of water, this is not a requirement. In some cases, satisfactory operation may be achieved with less recycled water than so determined, or no recycled water at all.

The reactors diagrammed in the illustrations consist essentially of a blank of heavy-walled pipes of a diameter preferably providing a velocity resulting in turbulent-flow, whose horizontal sections are connected by 180° bends. The illustration of three horizontal sections in series is diagrammatic. On the commercial scale, more than three pipe sections in series maybe required to provide the necessary retention time while each reactor will normally comprise several banks of such pipes in parallel. It is not necessary that they be horizontal, or that the flow through a bank of pipes be downward, as illustrated. The flow may be upward or a combination of upflow and downflow banks may be employed. While pipe bank reactors are a convenient means of achieving turbulent mixing of gas and slurry phases, other types of reactors providing suitable mixing and retention time may be substituted. For example, a cylindrical pressure vessel or a plurality of such vessels may be employed. Such reactors may be equipped with baffles, mechanical agitators, or other means of enhancing the mixing of phases.

To be suitable for the process of this invention, a reactor must be at least partially adiabatic, i.e., the heat of combustion must be at least partially applied to raising the temperature of the reaction mixture flowing through it. However, some of the combustion heat may be extracted during the course of the combustion by indirect heat transfer (as to boiling feedwater) so long as the amount extracted is less than the total liberated.

While, in the illustrations, the number of parallel reaction trains was chosen to be the same as the number of turbine-compressor stages, it is not a requirement that these numbers correspond.

For convenience in discussing heat recovery and phase separation, I shall refer to heat at a temperature sufficient to generate product steam as "high level heat". Upon completion of combustion, the high level heat content of reactor effluents is recovered by heat exchange for use internal to the process, as in the case of the flue gas superheat exchangers illustrated, and as the useful product of the process, as in the case of the boilers and steam superheat exchangers. In the illustrated embodiments, the proportion utilized internally to superheat flue gas is regulated so that, during normal operation, the power produced by the flue gas turbines balances the power consumed by the corresponding air compressors.

It is possible to vary the disposition of high level heat so that the flue gas turbines generate surplus shaft horsepower for export as a useful product (at the expense of steam superheat), or so that additional steam is generated and/or additional superheat imparted to the generated steam (at the expense of needing supplemental horsepower to drive the air compressors).

Another logical alternative is to utilize some of the high level heat in the reactor effluents to reheat product steam between stages of the conventional turbo-generators which have not been illustrated, but which will usually comprise a complimentary adjunct to a commercial application of the process of the invention.

Even though the turbine-compressor sets are in nominal balance in the illustrated embodiments, it is necessary to provide a supplemental steam turbine or motor with at least one of the sets for bringing the apparatus on-stream from a cold start.

As the reaction effluents are cooled in the process of recovery of high level heat, the dewpoint is reached and water vapor begins to condense to liquid water. In the example of FIG. 1, a vapor-liquid (or slurry) separation is performed after completion of high level heat recovery, whereas, in the example of FIG. 2, a first separation is performed while this heat recovery is incomplete and a second separation performed after its completion. Simple gravity-type separators are shown in the drawings. Under some conditions of operation, it may be desirable to substitute other types of phase separating devices such as the cyclonic type.

When cooling a mixture comprising gaseous, liquid and solid phases, a difficulty with plugging of equipment is sometime encountered in the vicinity of the dewpoint. This is because, for a short distance of travel, the liquid-solid ratio may be too low to comprise a fluid slurry. Instead, passages may be obstructed with a liquid-solid mixture best described as "mud". In apparatus for the process of this invention, this difficulty, if it arises, may be overcome by injecting hot water, or fluid slurry, as from the discharge of the internal recycle pump, at a point upstream of the condition.

Combustion heat remaining in the flue gas and ash slurry after maximum economic recovery of high level heat is subject to recovery by transfer to relatively cold incoming streams, principally coal slurry and boiler feedwater. It will be apparent to those skilled in the art that numerous alternative heat exchange arrangements for recovering this low level heat may be used, depending upon such local circumstances as the temperature at which boiler feedwater is returned to the apparatus. While the arrangement for preheating boiler feedwater illustrated in the drawings is adequate for a general understanding of the heat balance of those particular embodiments, it will be understood that a practical system would probably be more complex. For example, the several boiler feedwater heat exchangers would probably operate at comparatively low pressure on the feedwater side, flow being provided by a primary feedwater pump off-site. The preheated feedwater would then be held briefly in an accumulator or "de-aerator" of conventional proprietary type before being boosted in pressure to the level needed to supply the boilers by a main boiler feedwater pump.

To avoid accumulation of dissolved solids in the water recirculating to the boilers from their respective steam drums, a small amount (called "blow-down") is continuously or intermittently withdrawn from each of the systems via connections not shown in the illustrations.

The net production of ash slurry (comprising, for example, a portion of that separated from flue gas in the single separator of the embodiment of FIG. 1 or essentially all of that separated in the primary separators of the embodiment of FIG. 2) is subjected to heat recovery and then separated further into ash, for disposition external to the apparatus, and a clarified solution. Although gravity settlers were illustrated as the solid-liquid separating device, other types of such devices known to the art, for example, filters or centrifuges, may be used.

All of the solution separated from the ash may be discarded. However, part is normally recycled to the fuel feed slurrying system (external recycle) and part purged from the system. The purpose of the purge is to reject essentially all of the soluble impurities from the system. A purpose of the external recycle is to build up the concentration of these soluble materials so that a relatively small volume of purge will suffice to remove them at an equilibrium rate.

When soda ash is the alkali added to the feed slurry, the salts which form in the reaction system as well as those extracted from the coal ordinarily remain in liquid phase and are purged from the clarified solution. However, when less soluble alkalis, such as limestone, are employed, calcium compounds may remain or become of solid state and be removed along with the ash.

Water soluble salts purged when soda ash is used may represent a disposal problem and therefore may be treated with lime or limestone externally to the system to convert them into comparatively insoluble calcium salts, regenerating the soda ash solution for re-use. This treatment uses technology known to so-called "double alkali" processes for scrubbing conventional flue gasses.

The power consumed in compressing combustion air is considerable, but is offset by the power available from expansion of the flue gas, which may be augmented by increasing its volume by control of water vapor content and temperature. It is logical, although not required, to couple the expansion turbines directly to the air compressors.

The designer of apparatus for the process of the invention has considerable latitude in his choice of turbine and compressor inlet temperatures and pressures. While, for example, the horsepower of compressors is ordinarily minimized by cooling the compressed gas as much as possible between stages, as has been illustrated by the use of final intercoolers cooled by plant cooling water, an interesting alternative is to omit the final intercoolers. Although the horsepower of both compressors and the turbines driving them must be increased, the thermal efficiency of the apparatus as a whole is improved because the heat formerly lost to cooling water is retained within the system.

While a more-or-less conventional economizer for recovering residual low-level heat from the flue gas discharged to atmosphere has been illustrated, the use of such means of minimizing heat loss in flue gas is also optional to the designer. By suitable adjustment to interstage temperatures and pressures, the final stage of expansion may extract sufficient energy to cool the flue gas to a temperature as low as permitted by environmental regulations. This temperature could even be as low as that of ambient air, if this were permitted, completely eliminating heat loss in flue gas.

An important feature of the preferred embodiments is the recycling of hot water from the separators back to the inlets of the combustion reactors. While the primary purpose of this recycle is, in these examples, to insure that liquid water is available to slurry the coal and ash particles up to the critical temperature, detailed heat balances establish that recycling water through a pressurized combustion and heat recovery system serves another function of broad applicability. It acts as a "thermal flywheel", absorbing heat from the combustion by changing state from liquid to vapor and subsequently delivering this heat in the heat recovery equipment (if the system is under suitable pressure) by changing back to the liquid state. In a combustion system operated, for example, at 4000 pounds per square inch, it is quite feasible to so generate steam at a pressure of 2000 pounds per square inch without exceeding a combustion temperature of 1000° F. This discovery provides a useful means of limiting the temperature of a combustion without loss of heat efficiency. Several objectives for limiting combustion temperatures have already been cited: less expensive construction materials, avoidance of nitrogen oxides, oxidation of sulfur to the more easily removed trioxide. Other objectives will be apparent to those skilled in the engineering arts.

For heat to flow from water vapor condensing in the hot side of a steam boiler for my process the condensing temperature must be higher than the boiling temperature on the cold side of the exchange. This translates, by well known relationships, into the necessity for a higher steam partial pressure on the hot, or reaction, side than in the product steam. In addition to this reaction side steam partial pressure there is, unavoidably, a partial pressure of flue gas, necessitating a total pressure substantially above product steam pressure. This pressure relationship is characteristic of the process when used for generating steam.

Although described mainly with reference to the generation of superheated steam the process of my invention is also useful as a source of heat for industry, drying, space heating and the like. In some such applications heat may be transferred indirectly to the end use by means of saturated steam, Dowtherm, circulating oil or water or other heat transfer medium, or the transfer may be made directly between the reaction effluent and the material to be heated. In many cases, product steam may first be used in a "topping" turbine to produce electricity or mechanical energy, the turbine exhaust then being used for process or heating purposes. Various other energy end use alternatives will be apparent to those skilled in the art.

In general, the operating pressure for my process is determined by the temperature level at which heat is required. As already pointed out, generating steam requires an operating pressure higher than steam pressure. When generating high pressure steam the operating pressure is correspondingly high whereas, for lower pressure steam and heating services not requiring high temperatures, operating pressure may be considerably lower.

Having described my invention, I claim:

1. A process for converting the heating value of a fuel to useful heat comprising the steps of:

charging the fuel together with air and water to a pressurized combustion zone in which liberation of combustion heat causes the temperature to rise above the critical temperature of water;

extracting useful heat so as to cool the combustion products below their dewpoint;

separating an aqueous condensate from the cooled combustion products; and recycling a portion of the aqueous condensate to the combustion zone as a source of the water charged thereto.

2. A process as in claim 1 in which an alkaline compound is added to the water charged with the fuel and the air to the pressurized combustion zone.

3. A process as in claim 1 in which the pressure of the pressurized combustion zone is between 1000 and 10,000 pounds per square inch and the amount of water charged with the fuel and the air is regulated so that the temperature in the combustion zone rises to between 710° and 1800° F.

4. A process for converting the heating value of a carbonaceous fuel to useful energy comprising the steps of:

grinding the fuel to form particles;

mixing the fuel particles with an alkaline aqueous fluid to form a fuel slurry;

contacting the fuel slurry with air and additional water in a pressurized combustion zone in which liberation of combustion heat causes the temperature to rise above the critical temperature of water;

extracting useful heat from a mixture leaving the combustion zone so as to cool the mixture below the critical temperature of water and below the dewpoint of the mixture;

separating an aqueous condensate from the cooled mixture; and recycling a portion of the aqueous condensate to the inlet of the combustion zone as a source of the additional water charged thereto.

5. A process as in claim 4 in which the remainder of the aqueous condensate is subjected to the further steps of:

cooling the remainder of the aqueous condensate;

separating therefrom solid particles to form a clarified condensate; and recycling a portion of the clarified condensate to the point of mixing of the fuel particles with the alkaline aqueous fluid as an ingredient thereof.

6. A process as in claim 4 in which the pressure of the pressurized combustion zone is between 1000 and 10,000 pounds per square inch and the amount of the additional water charged with the fuel slurry and the air is regulated so that the temperature in the combustion zone rises to between 710° and 1800° F.

7. A process for converting the heating value of a carbonaceous fuel to useful energy comprising the steps of:

grinding the fuel to form particles;

mixing the fuel particles with an alkaline aqueous fluid to form a fuel slurry;

contacting the fuel slurry with air and additional water in a pressurized combustion zone in which liberation of combustion heat causes the temperature to rise above the critical temperature of water;

extracting a first portion of useful heat from the mixture leaving the combustion zone so as to cool the mixture below the critical temperature of water and below the dewpoint of the mixture;

separating the cooled mixture into a vapor phase and a first aqueous condensate;

extracting a second portion of useful heat from the vapor phase so as to cool the vapor phase below its dewpoint;

separating therefrom a second aqueous condensate; and recycling the second aqueous condensate to the inlet of the combustion zone as a source of the additional water charged thereto.

8. A process as in claim 7 in which the first aqueous condensate is subjected to the further steps of:

cooling the first aqueous condensate;

separating therefrom solid particles to form a clarified condensate; and recycling a portion of the clarified condensate to the point of mixing of the fuel particles with the alkaline aqueous fluid as an ingredient thereof.

9. A process as in claim 7 in which the pressure of the pressurized combustion zone is between 1000 and 10,000 pounds per square inch and the amount of the additional water charged with the fuel slurry and the air is regulated so that the temperature in the combustion zone rises to between 710° and 1800° F.

10. A process as in claim 1 in which a portion of the heat of combustion is extracted from the pressurized combustion zone, the unextracted portion of the heat of combustion being sufficient to raise the temperature in the combustion zone above the critical temperature of water.

11. A process as in claim 4 in which a portion of the heat of combustion is extracted from the pressurized combustion zone, the unextracted portion of the heat of combustion being sufficient to raise the temperature in the combustion zone above the critical temperature of water.

12. A process as in claim 7 in which a portion of the heat of combustion is extracted from the pressurized combustion zone, the unextracted portion of the heat of combustion being sufficient to raise the temperature in the combustion zone above the critical temperature of water.

13. A process as in claim 1 in which the step of extracting useful heat from the mixture leaving the combustion zone comprises the steps of:

indirectly transferring heat from the mixture to steam to raise the temperature thereof;

indirectly transferring additional heat from the mixture to a gaseous product of the combustion to raise the temperature thereof; and indirectly transferring further additional heat from the mixture to boiler feedwater to convert the feedwater into steam.

14. A process as in claim 4 in which the step of extracting useful heat from the mixture leaving the combustion zone comprises the steps of:

indirectly transferring heat from the mixture to steam to raise the temperature thereof;

indirectly transferring additional heat from the mixture to a gaseous product of the combustion to raise the temperature thereof; and indirectly transferring further additional heat from the mixture to boiler feedwater to convert the feedwater into steam.

15. A process as in claim 7 in which the step of extracting useful heat from the mixture leaving the combusion zone comprises the steps of:

indirectly transferring heat from the mixture to steam to raise the temperature thereof;

indirectly transferring additional heat from the mixture to a gaseous product of the combustion to raise the temperature thereof; and indirectly transferring further additional heat from the mixture to boiler feedwater to convert the feedwater into steam.

16. A process for generating steam from the heat of combustion of a fuel which includes the steps of:

charging the fuel to a pressurized combustion zone; and transferring heat from combustion products to water boiling under pressure, the pressure of the combustion zone being at least 100 pounds per square inch greater than the pressure of the boiling water.

* * * * *